US010381717B2

(12) United States Patent
Kerselaers et al.

(10) Patent No.: US 10,381,717 B2
(45) Date of Patent: Aug. 13, 2019

(54) AUTOMOTIVE ANTENNA

(71) Applicant: NXP B.V., Eindhoven (NL)

(72) Inventors: Anthony Kerselaers, Herselt (BE); Liesbeth Gommé, Anderlecht (BE)

(73) Assignee: NXP B.V., Eindhoven (NL)

( * ) Notice: Subject to any disclaimer, the term of this patent is extended or adjusted under 35 U.S.C. 154(b) by 256 days.

(21) Appl. No.: 15/462,625

(22) Filed: Mar. 17, 2017

(65) Prior Publication Data

US 2018/0269566 A1 Sep. 20, 2018

(51) Int. Cl.
*H01Q 1/32* (2006.01)
*H01Q 1/48* (2006.01)
(Continued)

(52) U.S. Cl.
CPC ..... *H01Q 1/32* (2013.01); *H01Q 1/38* (2013.01); *H01Q 1/48* (2013.01); *H01Q 5/30* (2015.01);
(Continued)

(58) Field of Classification Search
CPC ..... H01P 7/082; H01Q 9/28; H01Q 5/328; H01Q 9/30; H01Q 9/285; H01Q 5/378; H01Q 5/385; H01Q 5/932; H01Q 9/38
See application file for complete search history.

(56) References Cited

U.S. PATENT DOCUMENTS 4,063,246 A 12/1977 Greiser
5,949,383 A * 9/1999 Hayes ..... H01P 5/10 333/26
(Continued)

FOREIGN PATENT DOCUMENTS

WO 97/26685 A1 7/1997

OTHER PUBLICATIONS

Bhaskar, S. et al. "Compact planar rectangular monopole antenna for Bluetooth and UWB Applications", IEEE Uttar Pradesh Section International Conference on Electrical, Computer and Electronics Engineering (UPCON), Varanasi, pp. 138-141 (2016).
(Continued)

*Primary Examiner* — Ricardo I Magallanes
(74) *Attorney, Agent, or Firm* — Rajeev Madnawat

(57) ABSTRACT

An antenna for transmitting a first frequency and a second frequency signals is enclosed. The antenna includes a first metallic section having a first end and a second end, a second metallic section located on a side of the first metallic section and having a first end and a second end. The second metallic section is separated from the first metallic section by a first non-conducting gap. The antenna further includes a third metallic section located on a side of the second metallic section and having a first end and a second end. The third metallic section is separated from the second metallic section by a second non-conducting gap. The first end of the first metallic section is connected to a first electronic circuit, the first end of the third metallic section is connected to a second electronic circuit, and the first end of the second metallic section is connected to a feeding port. The second end of the first metallic section is electrically attached to a first metallic plate. The second end of the third metallic section is electrically attached to a second metallic plate. The second end of the second metallic section is attached to a third metallic plate, wherein the first second metallic section having a first length and the third metallic plate having a second length and wherein the first length plus the second length is greater than a length of the first metallic section or the third metallic section.

17 Claims, 4 Drawing Sheets

(51) Int. Cl.

| | |
|---|---|
| ***H01Q 5/30*** | (2015.01) |
| ***H01Q 1/38*** | (2006.01) |
| ***H01Q 9/28*** | (2006.01) |
| ***H01Q 9/40*** | (2006.01) |
| ***H01Q 5/328*** | (2015.01) |
| ***H01Q 5/357*** | (2015.01) |

(52) U.S. Cl.
CPC ..... *H01Q 5/328* (2015.01); *H01Q 5/357* (2015.01); *H01Q 9/28* (2013.01); *H01Q 9/40* (2013.01)

(56) References Cited

U.S. PATENT DOCUMENTS

| | | | | |
|---|---|---|---|---|
| 6,961,028 | B2 | 11/2005 | Joy et al. | |
| 9,680,213 | B2 * | 6/2017 | Pan | H01Q 1/48 |
| 2003/0048226 | A1 | 3/2003 | Gothard et al. | |
| 2004/0056805 | A1 * | 3/2004 | Chen | H01Q 1/243 343/700 MS |
| 2006/0158383 | A1 * | 7/2006 | Kwon | H01Q 9/28 343/795 |
| 2016/0043468 | A1 * | 2/2016 | Onaka | H03H 7/40 343/750 |
| 2017/0062932 | A1 * | 3/2017 | Foster | H01Q 7/00 |
| 2017/0264975 | A1 * | 9/2017 | Wong | H01Q 5/328 |

OTHER PUBLICATIONS

Aboufoul, T. "Multiple-parameter reconfiguration in a single planar ultra-wideband antenna for advanced wireless communication systems", IET Microwaves, Antennas & Propagation, vol. 8, No. 11, pp. 849-857 (Aug. 2014).

* cited by examiner

AUTOMOTIVE ANTENNA

BACKGROUND

In radio and telecommunication applications a dipole antenna is the simplest and most widely used class of antenna. The dipole is any one of a class of antennas producing a radiation pattern approximating that of an elementary electric dipole with a radiating structure supporting a line current so energized that the current has only one node at each end. A dipole antenna commonly consists of two identical conductive elements such as metal wires or rods, which are usually bilaterally symmetrical. The driving current from the transmitter is applied, or for receiving antennas the output signal to the receiver is taken, between the two halves of the antenna. Each side of the feedline to the transmitter or receiver is connected to one of the conductors. This contrasts with a monopole antenna, which consists of a single rod or conductor with one side of the feedline connected to it, and the other side connected to some type of ground. A common example of a dipole is the "rabbit ears" television antenna found on broadcast television sets.

Automobiles are fitted with antennas for various uses, as for example, for receiving radio signals, Wi-Fi and GPS signals, mobile communication signals, etc. Automobile to automobile communication (C2C) is now becoming a phenomenon to enable automobiles to communicate with each other for various reasons including providing a safe driving experience on public highways.

Automobile to Everything (C2X) communication is believed to be a key technology in contributing to safe and intelligent mobility in the future. Today's vehicles are equipped with many wireless services to receive radio and television broadcasting and to support communication like cellular phone and GPS for navigation. Even more communication systems will be implemented for "intelligent driving", such as wireless access in vehicular environments (WAVE), a vehicular communication system. As a result, the number of automotive antennas is increasing and the miniaturization requirements are becoming an important factor to reduce the cost. Combining two or more antennas for different frequency spectrums in one antenna structure is therefore an important asset for automotive antenna design.

C2X communication systems in Europe and USA make use of the IEEE802.11p standard, which operates in bands ITS-G5A, ITS-G5B and ITS-G5D: 5.855-5.925 GHz The Japanese ARIB STD-T109 standard dedicates the 700 MHz band to Intelligent Transport Systems. The operating frequency band to be used shall be 755.5-764.5 MHz, with a center frequency of 760 MHz and an occupied bandwidth of 9 MHz or less.

Since there is a dependency of antenna size on frequency, supporting a frequency as low as 760 MHz poses challenges in terms of keeping the height of the antenna design within the specification of the application.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, an antenna for transmitting a first frequency and a second frequency signals is enclosed. The antenna includes a first metallic section having a first end and a second end, a second metallic section located on a side of the first metallic section and having a first end and a second end. The second metallic section is separated from the first metallic section by a first non-conducting gap. The antenna further includes a third metallic section located on a side of the second metallic section and having a first end and a second end. The third metallic section is separated from the second metallic section by a second non-conducting gap. The first end of the first metallic section is connected to a first electronic circuit, the first end of the third metallic section is connected to a second electronic circuit, and the first end of the second metallic section is connected to a feeding port. The second end of the first metallic section is electrically attached to a first metallic plate. The second end of the third metallic section is electrically attached to a second metallic plate. The second end of the second metallic section is attached to a third metallic plate, wherein the first second metallic section having a first length and the third metallic plate having a second length and wherein the first length plus the second length is greater than a length of the first metallic section or the third metallic section. The first frequency is not harmonically related to the second frequency In some embodiments, the length of the first metallic plate is approximately equal to a quarter wavelength of the first frequency. The length of the second metallic section plus the length of the third metallic plate is substantially equal to a quarter wavelength of the second frequency. The first metallic plate has a length less than the length of the first metallic section and there is a third non-conducting gap between the first metallic plate and the first metallic section and a length of the third non-conducting gap is less than the length of the first plate. The second metallic plate has a length less than the length of the third metallic section and there is a fourth non-conducting gap between the second metallic plate and the third metallic section and a length of the fourth non-conducting gap is less than the length of the second plate. The length of the second metallic section is more than the length of the first metallic section. In some embodiments, the first electronic circuit and the second electronic circuit include same internal circuits. In other embodiments, the first electronic circuit and the second electronic circuit may include different internal circuits. The feeding port is configured to receive a signal having the first frequency and the second frequency signals to be transmitted through the antenna.

In some embodiments, each of the internal circuits includes a switch with one side configured to be coupled to ground. In another embodiment, each of the internal circuits a capacitor coupled to an inductor in parallel thus forming a resonance circuit. In yet another embodiment, each of the internal circuits includes a capacitor coupled to an inductor in series thus forming a resonance circuit. In some embodiments, the resonance circuit is tuned to resonate at the first frequency. In another embodiment, the resonance circuit is tuned to resonate at the second frequency. In some embodiments, the length of the first metallic section is substantially equal to length of the third metallic section.

In some embodiments, the first frequency is in a range from 5 GHz to 8 GHz and the second frequency is in a range from 650 MHz to 1000 MHz.

In some embodiments, the first metallic plate is wider than a width of the first metallic section and the width of the third non-conducting gap is narrower than a width of the first metallic plate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

Note that figures are not drawn to scale. Intermediate steps between figure transitions have been omitted so as not to obfuscate the disclosure. Those intermediate steps are known to a person skilled in the art.

DETAILED DESCRIPTION

Many well-known manufacturing steps, components, and connectors have been omitted or not described in details in the description so as not to obfuscate the present disclosure.

The antenna described herein is suitable, among others, for integration in a shark fin which is typically attached to the roof of a vehicle. One of the main requirements is that the radiation pattern should be omnidirectional as to reach all possible vehicles in the vicinity. This requirement is difficult to achieve in practice due to the placing of multiple antennas into one very small volume of the shark fin. A typical antenna with good efficiency is a monopole antenna. Such an antenna typically has a length of a quarter wave length. A single resonant antenna element has dimensions, which are inversely proportional to the frequency of operation. Hence, low operating frequencies require large antenna structures. A resonant quarter wave monopole antenna ($L=\lambda/4$) is a classical antenna that is used above a rooftop of a vehicle or above a ground plane. Various communication systems use different frequencies to communicate and as such their antennas have different lengths. All these antennas are influencing each other in such a way that radiation pattern shapes are altered.

One or more embodiments described herein provide that an antenna for a higher frequency band is placed at the highest position above the ground plane as to decrease the influence from other communication systems. Further, the embodiments provide an antenna for communication for the IEEE802.11p standard in Europe and the US, RLAN and for the Japan ITS standard. The embodiments described herein also minimize coaxial feeding cables as to reduce cost by providing a single feeding port for antennas for different frequency bands and accept signals from at least two frequency bands that are not harmonically related. The antenna described herein may provide omnidirectional radiation patterns or patterns that are not substantially directional for all frequency bands.

Figure 1:
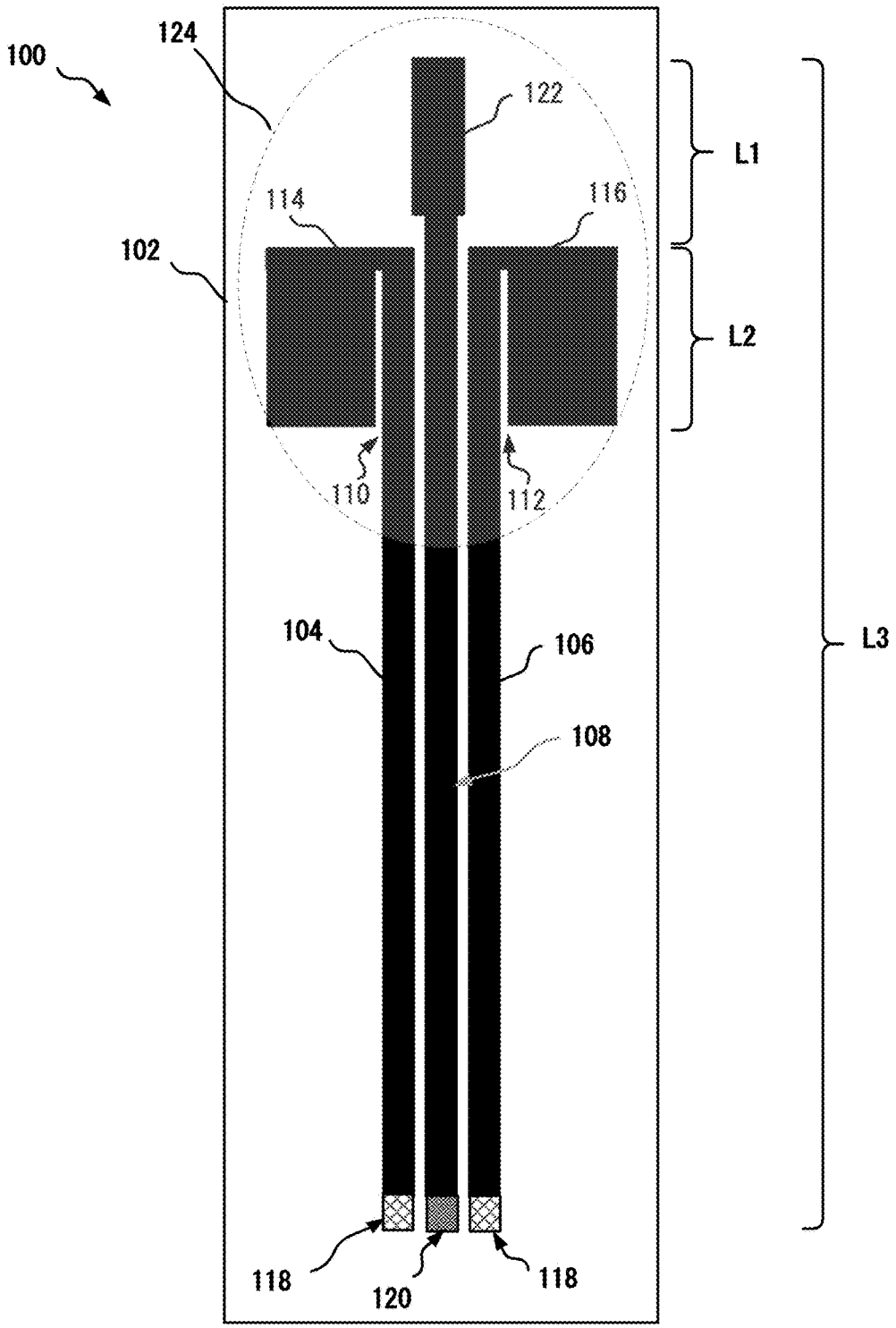
FIG. 1 depicts a schematic diagram of an antenna in accordance with one or more embodiments of the present disclosure.

FIG. 1 depicts a schematic diagram of an antenna 100. The antenna 100 is a dual band antenna that can transmit or receive signals of a first frequency and a second frequency. The first and the second frequencies reside in different frequency spectrums or bands. The antenna 100 includes a non-conducting surface 102. The non-conducting surface 102 may be a printed circuit board (PCB) or plastic or any sturdy material that does not conduct electricity. The antenna 100 includes a first metallic section 104 made of a conducting material such as copper and laid on the non-conducting surface 102. The antenna 100 also includes a second metallic section 108 made of a conducting material and located next to or alongside the first metallic section 104 and separated by a gap such that the first metallic section 104 and the second metallic section 108 do not touch each other. The antenna 100 further includes a third metallic section 106 located next to or alongside the second metallic section 108 and made of a conducting material. In one or more embodiments, the first metallic section 104, the second metallic section 108 and the third metallic section 106 are elongated. There is a gap between the second metallic section 108 and the third metallic section 106 such that the second metallic section 108 does not touch the third metallic section 106.

The first metallic section 104 is attached to an electronic circuit 118 on one end and to a metallic plate 114 alongside it at the other end. The metallic plate 114 is attached to the first metallic section 104 such that there is a gap 110 between the first metallic section 104 and the metallic plate 114. Similarly, the third metallic section 106 is attached to a metallic plate 116 alongside the third metallic section 106 such that there is a gap 112 between the third metallic section 106 and the metallic plate 116 along a part of the length of the metallic plate 116. The length L2 of the plate 114 is substantially equal to the quarter wavelength of the first frequency. Also, the lengths of the gaps 110, 112 are slightly less than the quarter wavelength of the first frequency. In some examples, for optimal antenna performance, the lengths of the gaps 110, 112 are approximately 95% to the quarter wavelength of the first frequency leaving approximately 5% length of the metallic plates 114, 116 to provide an electrical connection between the first metallic section 104 and the metallic plate 114, and also the same for the third metallic section 106 and the metallic plate 116. The gaps 110, 112 are provided to reduce the common mode current or radiation from sections 104, 106 and 108 so that interference from the sections 104, 106 and 108 to other antennas or devices can be reduced. A person skilled in the art would know that if the lengths of the gaps 110, 112 are close to the quarter wavelength of the first frequency, the antenna 100 would provide a more optimal reduction in the common mode currents.

Another metallic plate 122 is attached to the end of the second metallic section 108 and extends the second metallic section 108, as such the length L1 is substantially equal to the length L2. That is the length L1 is equal or approximately equal to the length L2. An encircled portion 124 including the metallic plates 114, 116 including the upper portion of the second metallic section 108 and the metallic plate 122 form a high band antenna serving the first frequency.

The second metallic section 108 is connected to a feeding port 120, as shown. The feeding port 120 is configured to be coupled with the transmitter/receiver (not shown) that may use the antenna 100 for transmitting and/or receiving signals. The length L3 of the second metallic section 108 and the metallic plate 122 combined may be substantially equal to the quarter wavelength of the second frequency. In some embodiments, the width of the metallic plates 114, 116 may be greater than the width of the first metallic section 104 and the second metallic section 106 respectively. In some embodiments, the widths of the first, second and third metallic sections 104, 108, 106 may be substantially same. In other embodiments, the width of the second metallic section 108 may be wider than the first metallic section 104. Further, in some examples, the width of the metallic plate 122 may be smaller than the width of the metallic plate 114 or the metallic plate 116. The length L3 may be greater than the length L1. In some embodiments, the overall length of the antenna 100 may be smaller than 15 millimeters. However, a person skilled in the art would realize that the over length of the antenna 100 may depend on the frequency bands for which the antenna 100 is designed.

The third metallic section 106 is connected to an electronic circuit 118 on the other end. This electronic circuit 118 may have the same internal circuitry as the electronic circuit 118 connected to the first metallic section 104.

The high band antenna operates as a halve wave dipole. A first quarter wavelength is formed by the conductive plate 122 while the second quarter wavelength is formed by conductive plates 114 and 116. Two gaps 110 and 112 are implemented to reduce common mode currents going down along the transmission line that is formed by the combination of the first metallic section 104, the second metallic section 108 and the third metallic section 106. As stated earlier, for optimum transfer of power from a communication system that may use the antenna 100 to the antenna 100, the lengths of the gaps 110, 112 may be quarter wavelength of the first frequency.

The low band antenna formed by the second metallic section 108 along with the metallic plate 122 operates as a quarter wave antenna for the second frequency. This is possible if the transmission line (formed by the combination of the first metallic section 104, the second metallic section 108 and the third metallic section 106) carries current in one direction only. This is accomplished by the electronic circuits 118.

In some examples, the non-conducting surface 102 may have a thickness of 1 or 1.6 mm. In an example only and just to illustrate the overall size of the antenna 100 for some communication applications such as C2X communication, the overall length and width of the non-conducting surface 102 may be 74 mm by 22 mm.

Figure 2A:
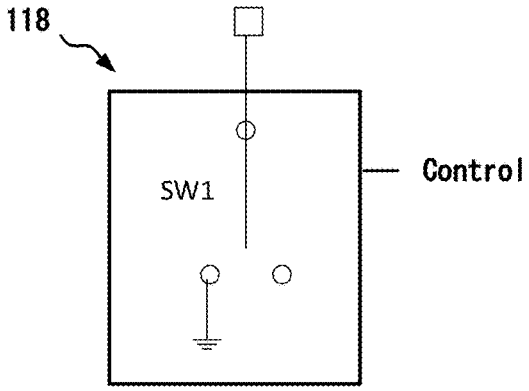
FIGS. 2A-2C depict structures of the internal circuit connected to the antenna in accordance with one or more embodiments of the present disclosure.
Figure 2B:
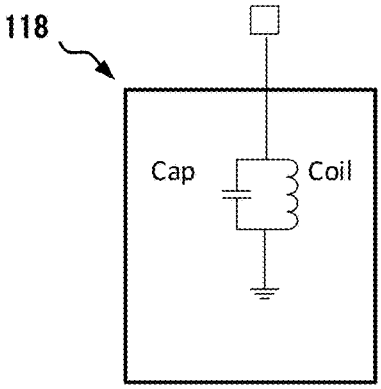
Figure 2C:
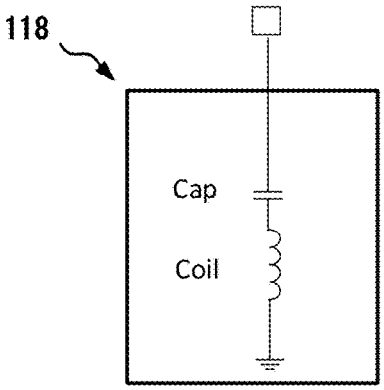

In some embodiments, the electronic circuit 118 that is connected to the first metallic section 106 may be different from the electronic circuit 118 that is connected to the third metallic section 106. FIGS. 2A-C illustrates some examples of the electronic circuit 118.

FIG. 2A shows the electronic circuit 118 in one embodiment. In this embodiment, the electronic circuit 118 includes a switch SW1. In the first position the switch SW1 is configured to connect the first metallic section 104 or the third metallic section 106 respectively, to ground. In this configuration, the high band antenna can operate because the transmission line has currents in opposite directions. In another configuration, the switches SW1 are open and the first metallic section 104 and the third metallic section 106 are open at the bottom. It should be noted that the switch SW1 may be driven by the communication system that uses the antenna 100. In this configuration, the transmission line has currents flowing in the same direction and the overall length of the second metallic section 108 plus the metallic plate 122 is a quarter wavelength of the second frequency and the entire antenna structure functions as a monopole antenna.

FIG. 2B shows the electronic circuit 118 in another embodiment in which a capacitor Cap and an inductor Coil are coupled in parallel. The values of Cap and Coil may be selected to resonate at the second frequency. In this configuration, the transmission line has currents in the same direction and the overall length of the second metallic section 108 plus the metallic plate 122 is a quarter wavelength of the second frequency and the entire antenna structure functions as a monopole antenna. For the first frequency, which is in a higher band than the second frequency, the combination of Cap and Coil is out of resonance and Cap functions as a short. In this configuration, the high band antenna can operate as the transmission line has currents in opposite directions.

FIG. 2C shows another example of the electronic circuit 118 with a series circuit of an inductor (Coil) and a capacitor (Cap). The values of these components are chosen to resonate at the first frequency. In this configuration, the high band antenna can operate because the transmission line has currents in opposite directions. For the second frequency, the series circuit is out of resonance and poses impedance and the transmission line has currents in the same direction and the length of the transmission line together with the high band antenna structure is a quarter wavelength with respect to the low frequency band such that the structure functions as a monopole antenna.

Figure 3:
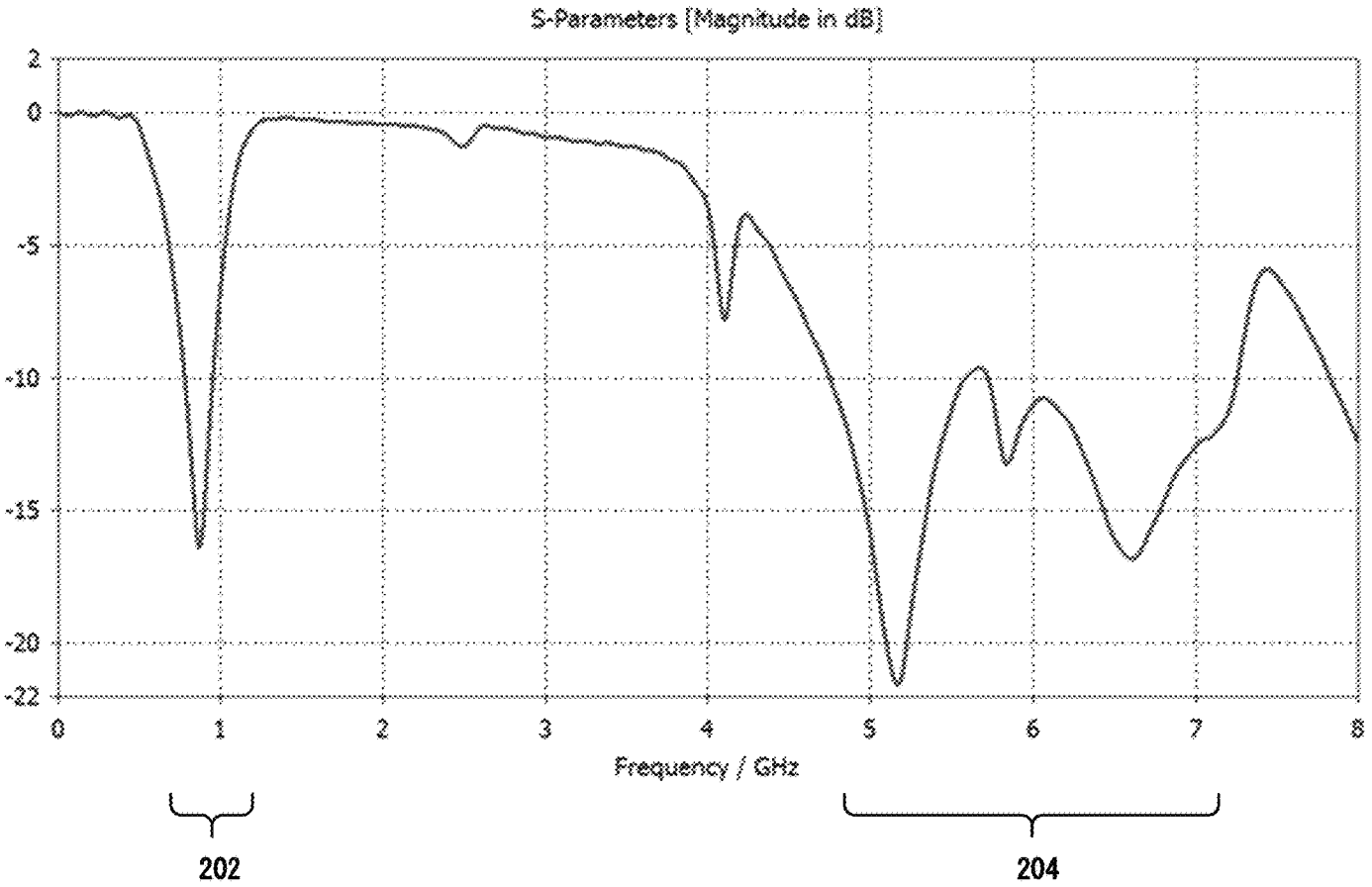
FIG. 3 shows a graph of a relationship between magnitude of power transferred from a transmission circuit to the antenna of FIG. 1 and transmission frequency in accordance with one or more embodiments of the present disclosure.

FIG. 3 shows simulated S-parameters [dB] of the antenna 100. The curve shows the input reflection coefficient of feeding port 120. As evident, there is a good matching of both frequency bands including the first frequency and the second frequency respectively. An efficient matching of the antenna to the transmitter (not shown) can be established with an input reflection coefficient of −10 dB or better (vertical axis). The higher frequency band 204 is in the frequency range 5-7 GHz while the lower frequency band 202 covers 0.7-0.9 GHz.

Figure 4:
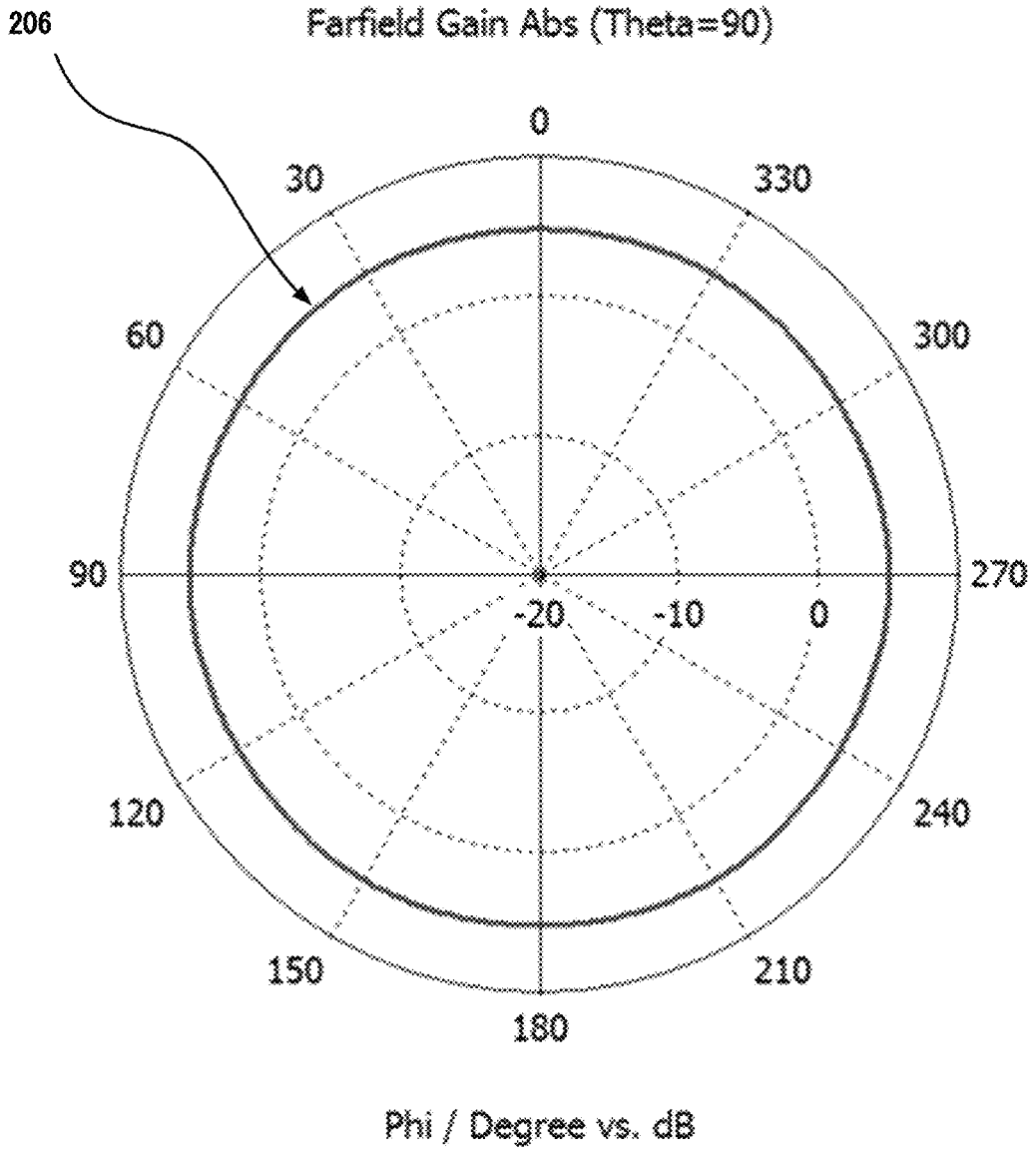
FIG. 4 illustrates a diagram to show omnidirectional characteristics of the antenna of FIG. 1.

FIG. 4 shows a simulated radiation pattern [dBi] of the antenna 100 in the horizontal plane at 5.9 GHz. The directivity of the radiation is omnidirectional with a gain of 5.22 dBi. As evident from the curve 206, the antenna 100 radiates omnidirectionally, as required for applications such as C2C or C2X communication.

Some or all of these embodiments may be combined, some may be omitted altogether, and additional process steps can be added while still achieving the products described herein. Thus, the subject matter described herein can be embodied in many different variations, and all such variations are contemplated to be within the scope of what is claimed.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. An antenna for transmitting a first frequency and a second frequency signals, comprising:

a first metallic section having a first end and a second end;

a second metallic section located on a side of the first metallic section and having a first end and a second end, wherein the second metallic section is separated from the first metallic section by a first non-conducting gap;

a third metallic section located on a side of the second metallic section and having a first end and a second end, wherein the third metallic section is separated from the second metallic section by a second non-conducting gap, wherein the first end of the first metallic section is connected to a first electronic circuit, the first end of the third metallic section is connected to a second electronic circuit, and the first end of the second metallic section is connected to a feeding port, wherein the second end of the first metallic section is electrically attached to a first metallic plate, wherein the second end of the third metallic section is electrically attached to a second metallic plate, wherein the second end of the second metallic section is attached to a third metallic plate, wherein the second metallic section has a first length and the third metallic plate has a second length, wherein the first length plus the second length is greater than a length of the first metallic section or the third metallic section, wherein the length of the first metallic plate is approximately equal to a quarter wavelength of the first frequency, and the first length of the second metallic section plus the second length of the third metallic plate is substantially equal to a quarter wavelength of the second frequency.

2. The antenna of claim 1, wherein the first metallic plate has a length less than the length of the first metallic section and there is a third non-conducting gap between the first metallic plate and the first metallic section and a length of the third non-conducting gap is less than the length of the first metallic plate.

3. The antenna of claim 1, wherein the second metallic plate has a length less than the length of the third metallic section and there is a fourth non-conducting gap between the second metallic plate and the third metallic section and a length of the fourth non-conducting gap is less than the length of the second metallic plate.

4. There antenna of claim 1, wherein the length of the second metallic section is more than the length of the first metallic section.

5. The antenna of claim 1, wherein the first electronic circuit and the second electronic circuit include same internal circuits.

6. The antenna of claim 1, wherein the feeding port is configured to receive a signal having the first frequency and the second frequency signals to be transmitted through the antenna.

7. The antenna of claim 5, wherein each of the internal circuits includes a switch with one side configured to be coupled to ground.

8. The antenna of claim 5, wherein each of the internal circuits includes a capacitor coupled to an inductor in parallel thus forming a resonance circuit.

9. The antenna of claim 5, wherein each of the internal circuits includes a capacitor coupled to an inductor in series thus forming a resonance circuit.

10. The antenna of claim 8, wherein the resonance circuit is tuned to resonate at the first frequency.

11. The antenna of claim 8, wherein the resonance circuit is tuned to resonate at the second frequency.

12. The antenna of claim 1, wherein a length of the first metallic section is substantially equal to a length of the third metallic section.

13. The antenna of claim 1, wherein the first frequency is in a range from 5 GHz to 8 GHz.

14. The antenna of claim 1, wherein the second frequency is in a range from 650 MHz to 1000 MHz.

15. The antenna of claim 1, wherein the first metallic plate is wider than a width of the first metallic section.

16. The antenna of claim 2, wherein a width of the third non-conducting gap is narrower than a width of the first metallic plate.

17. The antenna of claim 1, wherein the first frequency is not harmonically related to the second frequency.

* * * * *